United States Patent [19]

Shafir

[11] 4,417,620

[45] Nov. 29, 1983

[54] METHOD OF RECOVERING OIL USING STEAM

[75] Inventor: Eleonora G. Shafir, Garland, Tex.

[73] Assignee: Mobil Oil Corporation, New York, N.Y.

[21] Appl. No.: 320,234

[22] Filed: Nov. 12, 1981

[51] Int. Cl.[3] ..... E21B 43/24; E21B 43/30

[52] U.S. Cl. ..... 166/245; 166/272

[58] Field of Search ..... 166/245, 268, 269, 272

[56] References Cited

U.S. PATENT DOCUMENTS

| | | | |
|---|---|---|---|
| 2,969,226 | 1/1961 | Huntington | 166/272 X |
| 3,272,261 | 9/1966 | Morse | 166/272 X |
| 3,467,191 | 9/1969 | Van Daalen et al. | 166/272 X |
| 3,537,526 | 11/1970 | Offeringa | 166/272 X |
| 4,088,188 | 5/1978 | Widmyer | 166/269 |
| 4,124,071 | 11/1978 | Allen et al. | 166/272 X |
| 4,166,502 | 9/1979 | Hall et al. | 166/272 X |

*Primary Examiner*—George A. Suchfield
*Attorney, Agent, or Firm*—Alexander J. McKillop; James F. Powers, Jr.; Lawrence O. Miller

[57] ABSTRACT

A method for the recovery of oil from a subterranean, viscous oil-containing formation by injecting steam into the lower portion of the formation, simultaneously injecting water into the formation to build up the pressure of the formation to about 300 psia, maintaining the formation pressure at about 300 psia during the steam drive, and producing oil from the upper portion of the formation.

2 Claims, 6 Drawing Figures

METHOD OF RECOVERING OIL USING STEAM

BACKGROUND OF THE INVENTION

1. Field of the Invention

The present invention relates to an improved steam drive method of recovering oil from a subterranean, viscous oil-containing formation.

2. Background of the Invention

Steam has been used in many different methods for the recovery of oil from subterranean, viscous oil-containing formations. The two most basic processes using steam for the recovery of oil includes a "steam drive" process and a "huff and puff" steam process. Steam drive involves injecting steam through an injection well into a formation. Upon entering the formation, the heat transferred to the formation by the steam lowers the viscosity of the formation oil, thereby improving its mobility. In addition, the continued injection of the steam provides the drive to displace the oil toward a production well from which it is produced. Huff and puff involves injecting steam into a formation through an injection well, stopping the injection of steam, permitting the formation to soak and then back producing oil through the original injection well.

I have found that the steam drive process for the recovery of viscous oil can be enhanced by injecting steam into the formation while maintaining a certain pressure in the formation near the injection well using water injection and producing oil from the upper portion of the formation.

SUMMARY OF THE INVENTION

The invention relates to a method for recovering oil from a subterranean, viscous oil-containing formation employing a steam drive combined with injecting water into the formation to maintain the formation at a desired pressure level and producing oil from the upper portion of the formation. The formation is penetrated by at least one injection well for the injection of steam and at least one spaced apart production well for recovering oil from the formation. In addition, there is at least one additional injection well drilled into the formation near the steam injection well for injecting water into the formation. The steam injection well is located between the water injection well and the production well, within the recovery zone, e.g., that portion of the formation through which steam passes with respect to at least a portion of the vertical thickness of the formation. The steam injection well may be on a line between the injector and producer or offset therefrom. The steam injection well is in fluid communication with the lower portion of the formation and the water injection well is in fluid communication with a substantial portion of the formation. The production well is in fluid communication with the upper portion of the formation. Steam is injected into the formation via the steam injection well and fluids including oil are recovered from the upper portion of the formation via the production well. Simultaneously with the injection of steam, water is injected into the formation via the water injection well to build up the pressure of the formation to about 300 psia and this pressure is maintained in the formation during the steam drive by continuing the injection of water. Production of fluids including oil is continued until the fluids recovered contain an unfavorable amount of steam or water. Injection of water during the steam drive to maintain the pressure of the formation at 300 psia combined with producing oil from the upper portion of the formation enhances the recovery of oil from the formation.

DESCRIPTION OF THE PREFERRED EMBODIMENTS

Figure 1:
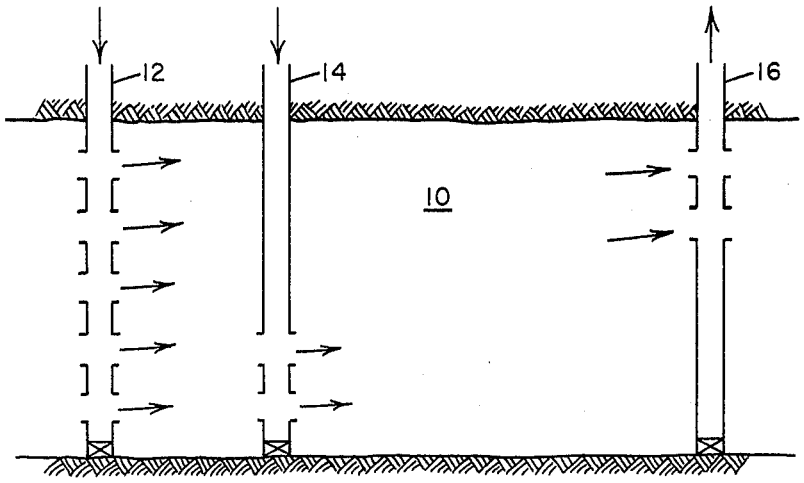
FIG. 1 illustrates a subterranean formation penetrated by three wells, a steam injection well, a water injection well, and a production well for carrying out the improved steam drive method for recovering oil according to my invention.

The process of my invention may be best understood by referring to the attached drawing in which FIG. 1 illustrates a relatively thick, viscous oil formation 10 penetrated by separate injection wells 12 and 14 used for the injection of water and steam into a selected portion of the formation and a spaced apart production well 16. Injection well 12 for the injection of water is perforated to establish fluid flow communication between the well and the formation throughout the full vertical thickness of the formation. Injection well 14 used for the injection of steam is perforated to establish fluid flow communication between the well and the lower portion of the formation. Production well 16 is perforated to establish fluid flow communication between the well and the upper portion of the formation.

Steam is injected into the lower portion of the formation 10 through injection well 14 and fluids including oil are recovered from the upper portion of the formation via production well 16.

Simultaneously with the injection of steam and oil production, water is injected into the formation through injection well 12 to build up the pressure within the formation to a desired level, preferably about 300 psia, and this pressure is maintained by continuing the injection of water during the steam drive phase of the recovery process. It will be noted that water injection well 12 is positioned ahead of steam injection well 14 so that pressure is maintained behind the steam front thereby obtaining maximum benefit of the steam in reducing the viscosity of the oil in the formation so as to enhance its recovery.

Steam injection is continued through well 14 while maintaining the formation pressure about 300 psia by water injection through well 12 until the fluids including oil recovered from production well 16 contain an unfavorable amount of water or steam. At this point, production is terminated.

Utilizing a computational model and computer program, I will demonstrate the enhanced oil recovery achieved from the application of my process.

A three-phase block oil simulator was used in a heavy oil formation containing about 1085 million barrels of total oil in place at a viscosity of 1000 cp and an API gravity of 12°.

Figure 2B:
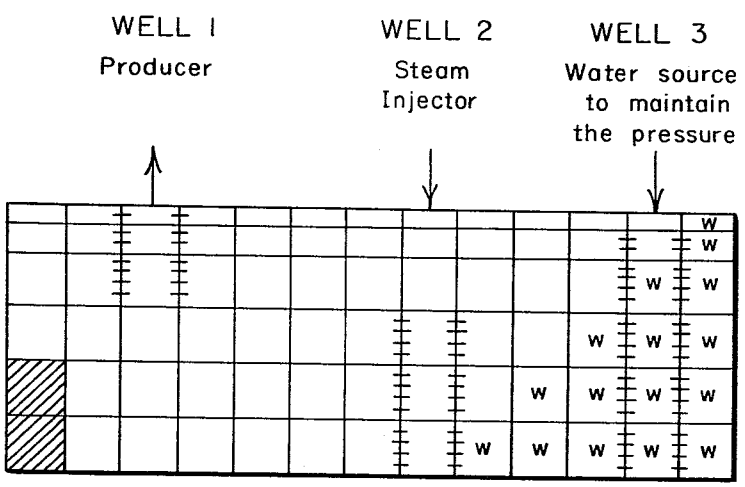
FIGS. 2A and 2B show grid systems for stimulation runs with the location of a steam injection well, a water injection well, and a producing well.
Figure 2A:
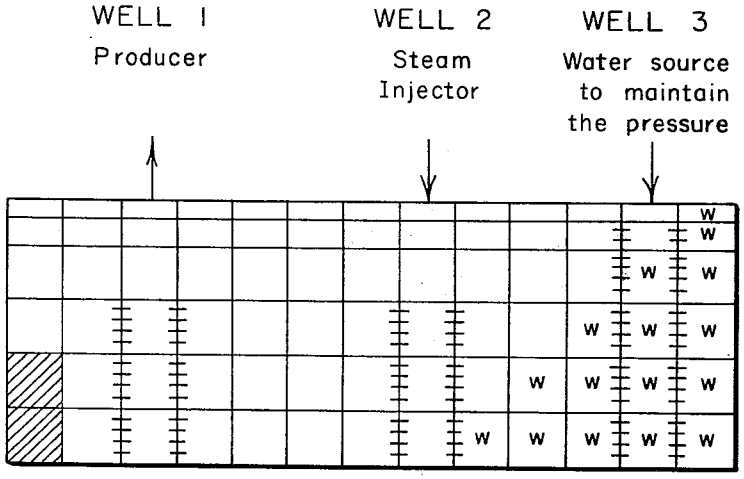

FIG. 2A shows a vertical cross section of the model formation used and location of three wells, a producing well 1 in fluid communication with the lower portion of the formation as indicated by the dashed lines, a steam injection well 2 in fluid communication with the lower portion of the formation as indicated by the dashed lines, and a water injection well 3 in fluid communication with a substantial portion of the formation as indicated by the dashed lines. FIG. 2B shows the same model as shown in FIG. 2A except that the producing well 1 is in fluid communication with the upper portion of the formation.

Figure 3:
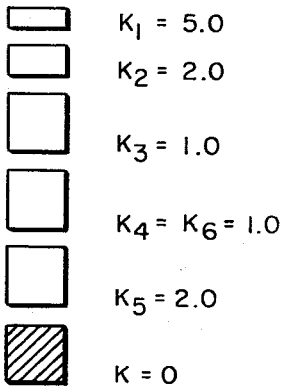
FIG. 3 illustrates the permeability of the layers of the formation shown in FIGS. 2A and 2B.

The model formation shown in FIGS. 2A and 2B is at a 0° dip angle and simulates a 3.24 acre experimental rectangular mode with 13 blocks in the X-direction and 6 blocks in the Z-direction. There are six layers varying in permeability from 0 to 5.0 with the permeability of each layer and several individual blocks shown in FIG. 3. The thickness of each layer from top to bottom is 5 feet, 15 feet, and the lower 4 layers 25 feet each. The cross-sectional thickness, $\Delta y$, is 200 feet and the width, $\Delta x$, is 54.4 feet. The total number of cells is 78 and 16 cells are water zones as indicated by the reference letter "W".

Figure 5:
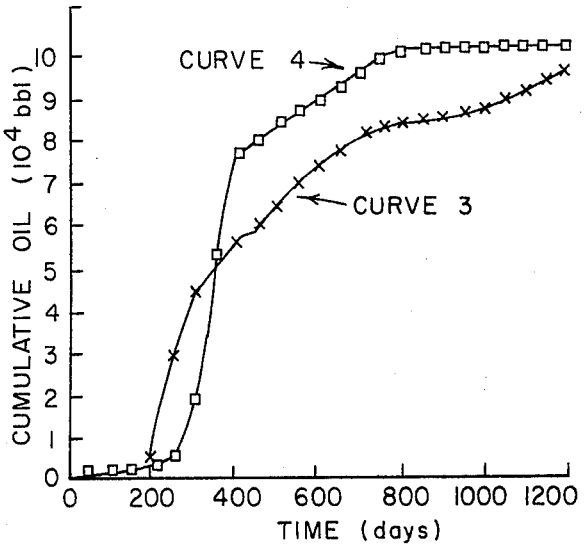
FIGS. 4 and 5 show the effect of varying completion of the production well on the cumulative oil production for a simulated model having a 0° dip angle and one having a 45° dip angle.
Figure 4:
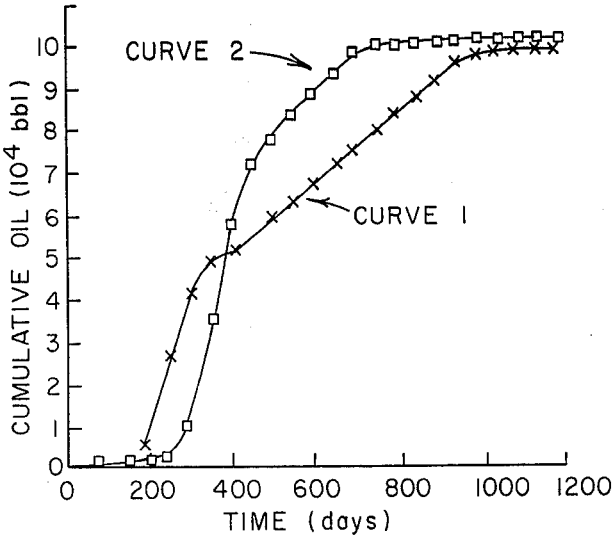

Four runs were made and the results are shown by the graphical representation of FIGS. 4 and 5. For all runs, the water source of Well 3 maintained a formation pressure of 300 psia and the steam and water injection was at a constant rate of 584 barrels per day. Bottomhole pressure, steam qualities, and the ratio of horizontal to vertical permeability ($K_v=0.15_h$) and initial conditions were held constant for all runs.

Curve 1 of FIG. 4 shows the cumulative oil production versus time in days for a run with a 0° formation dip angle and the producing well in fluid communication with the lower portion of the formation as illustrated in FIG. 2A. Curve 2 of FIG. 4 shows the effect of the producing well being in fluid communication with the upper portion of the formation as illustrated in FIG. 2B. The increase in the rate of cumulative oil production for the produced well completed in the upper portion of the formation as shown by Curve 2 over Curve 1 of FIG. 4 wherein the production well is completed in the lower portion of the formation is evident.

Curve 3 of FIG. 5 shows the cumulative oil production versus time in days for a run with a 45° formation dip angle and the producing well in fluid communication with the lower portion of the formation as illustrated in FIG. 2A. Curve 4 of FIG. 5 shows the effect of the producing well in fluid communication with the upper portion of the formation as illustrated in FIG. 2B. Again, the dramatic increase in the rate of cumulative oil production in the upper portion of the formation as shown by Curve 4 over Curve 3 of FIG. 5 is evident. As can be seen in these two FIGS., the rate of cumulative oil production is improved by completing the production well in the upper portion of the formation while maintaining the formation pressure at 300 psia during a steam drive.

The present invention may be carried out utilizing a large number of well patterns as illustrated in U.S. Pat. No. 3,927,716 to Burdyn et al.

From the foregoing specification, one skilled in the art can readily ascertain the essential features of this invention and without departing from the spirit and scope thereof can adopt it to various diverse applications.

What is claimed is:

1. A method for the recovery of oil from a subterranean, viscous oil-containing formation, said formation penetrated by at least three wells, a first injection well being in fluid communication with a substantial portion of the formation, a spaced apart production well being in fluid communication with only the upper portion of the formation, and a second injection well located between the first injection well and the production well in fluid communication with the lower portion of the formation and near the first injection well comprising:

(a) injecting steam into the lower portion of the formation via the second injection well;

(b) simultaneously injecting water into the formation via the first injection well so as to build up the formation pressure to a desired pressure level;

(c) maintaining the formation pressure at the desired level of step (b) by continuing water injection; and (d) recovering fluids including oil from the upper portion of the formation via said production well until the fluids recovered contain an unfavorable amount of steam or water.

2. The method of claim 1 wherein the formation pressure is built up and maintained during steps (b) and (c) at a pressure of about 300 psia.

* * * * *